US011815055B1

(12) United States Patent
Coldren et al.

(10) Patent No.: US 11,815,055 B1
(45) Date of Patent: Nov. 14, 2023

(54) MULTI-FUEL INJECTOR AND METHOD

(71) Applicant: Caterpillar Inc., Peoria, IL (US)

(72) Inventors: Dana R. Coldren, Secor, IL (US); Lifeng Wang, Dunlap, IL (US); Eric L. Schroeder, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/060,931

(22) Filed: Dec. 1, 2022

(51) Int. Cl.

| | |
|---|---|
| ***F02M 43/04*** | (2006.01) |
| ***F02M 51/06*** | (2006.01) |
| ***F02M 55/00*** | (2006.01) |
| ***F02M 47/04*** | (2006.01) |

(52) U.S. Cl.
CPC ..... *F02M 43/04* (2013.01); *F02M 47/046* (2013.01); *F02M 51/06* (2013.01); *F02M 55/002* (2013.01)

(58) Field of Classification Search
CPC ..... F02M 43/04; F02M 47/046; F02M 51/06; F02M 55/002
USPC ..... 123/470; 239/533.12, 585.5
See application file for complete search history.

(56) References Cited

U.S. PATENT DOCUMENTS

| | | | |
|---|---|---|---|
| 5,209,403 | A | 5/1993 | Tarr et al. |
| 7,707,993 | B2 | 5/2010 | Coldren et al. |
| 10,184,440 | B2 | 1/2019 | Caley |
| 10,371,065 | B2 | 8/2019 | Mumford et al. |
| 2009/0321536 | A1 | 12/2009 | Haji |

FOREIGN PATENT DOCUMENTS

| | | | | |
|---|---|---|---|---|
| CA | 2405468 | * | 7/2009 | ..... F02M 43/04 |
| CN | 106762276 | A | 5/2017 | |
| EP | 3580446 | * | 8/2021 | ..... F02M 61/20 |
| JP | 2004501306 | * | 1/2004 | ..... F02M 21/02 |
| JP | 2004204795 | * | 7/2004 | ..... F02M 61/10 |
| WO | WO 02090754 | * | 11/2002 | ..... F02M 47/02 |
| WO | WO 2004044414 | * | 5/2004 | ..... F02M 45/08 |

* cited by examiner

*Primary Examiner* — Hai H Huynh
(74) *Attorney, Agent, or Firm* — Bookoff McAndrews, PLLC

(57) ABSTRACT

A fuel injector capable of injecting a plurality of different fuels in a single fuel injection event includes a body including a primary fuel path and a pilot fuel path and a first plunger in fluid communication with the pilot fuel path. The fuel injector also includes a second plunger in fluid communication with the primary fuel path and with the pilot fuel path, a hydraulic control chamber within the pilot fuel path, and an injection valve at which the primary fuel path and the pilot fuel path connect to each other.

20 Claims, 3 Drawing Sheets

MULTI-FUEL INJECTOR AND METHOD

TECHNICAL FIELD

The present disclosure relates generally to methods and systems for internal combustion engine components and, more particularly, to a fuel injector configured to inject two different fuels.

BACKGROUND

While engines that operate by combustion of conventional fuels, such as gasoline or diesel fuel, are used in many applications, there is increasing interest in adapting engines for use with so-called "alternative fuels." Examples of alternative fuels include alcohol-containing fuels, such as methanol and ethanol. These fuels can provide benefits, for example, due to their environmentally-friendly qualities and ability to be generated with renewable sources of energy. However, complete combustion of an alternative fuel, including methanol, can be more challenging in comparison to conventional fuels. For example, methanol may have reduced energy density, slower vaporization time, lower cetane number, and/or other challenges. To address these drawbacks, some internal combustion engines are designed to inject two different fuels, including a pilot fuel that generates a pilot flame which combusts an alternative fuel in a more complete and predictable manner.

While multi-fuel internal combustion engines can improve combustion, the presence of the alternative fuel as the primary source of energy can introduce issues within the fuel injector itself. For example, the presence of alternative fuels, such as methanol, can cause increased cavitation damage, seat wear, and guide-surface scuffing. These issues can be caused by differences in the properties of the alternative fuel, including the alternative fuel's reduced lubrication ability in comparison to that of traditional fuels.

An exemplary high pressure fuel injector is described in U.S. Pat. No. 5,209,403 ("the '403 patent") to Tarr. The fuel injector described in the '403 patent has an internal structure that defines a timing chamber between upper and lower plungers. This timing chamber includes a relief valve for draining timing fluid during injection to control pressures at high speed operation. While the timing chamber and relief valve of the fuel injector described in the '403 patent can be useful for modifying a quantity of injected fuel by using the timing fluid, it is unable to inject two different types of fuel with a single injector and may be unable to protect components of the fuel injector from wear and/or damage associated with an alternative fuel.

The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a fuel injector capable of injecting a plurality of different fuels in a single fuel injection event may include a body including a primary fuel path and a pilot fuel path and a first plunger in fluid communication with the pilot fuel path. The fuel injector may also include a second plunger in fluid communication with the primary fuel path and with the pilot fuel path, a hydraulic control chamber within the pilot fuel path, and an injection valve at which the primary fuel path and the pilot fuel path connect to each other.

In another aspect, a fuel injection method may include receiving a primary fuel with a primary fuel path within a body of a fuel injector, receiving a pilot fuel with a pilot fuel path within the body of the fuel injector, and pressurizing pilot fuel within a hydraulic control chamber in the pilot fuel path. The method may also include supplying primary fuel to a nozzle portion of the fuel injector with a primary fuel plunger connected to the hydraulic control chamber, supplying pilot fuel to the nozzle portion of the fuel injector, and injecting the pilot fuel and the primary fuel from a nozzle of the fuel injector.

In yet another aspect, a fuel injector may include a body, a primary fuel connection configured to receive primary fuel, a pilot fuel connection configured to receive pilot fuel, and a plunger that is isolated from the primary fuel. The fuel injector may also include a hydraulic chamber defined in part with the plunger, the hydraulic chamber being in fluid communication with the pilot fuel connection, and a second plunger that, when actuated, is configured to deliver the primary fuel to a nozzle of the fuel injector.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of 10% in the stated value or characteristic. As used herein, "upper" refers to the proximal direction of a fuel injector, the proximal end being the farthest end of the injector when compared to the injection orifice(s) of the injector. As used herein, "lower" refers to the distal direction of the fuel injector, the distal end of the fuel injector including or being located closest to the injection orifice(s). Thus, the words "upper" and "proximal" may be considered interchangeable, and the words "lower" and "distal" may be considered interchangeable.

Figure 1B:
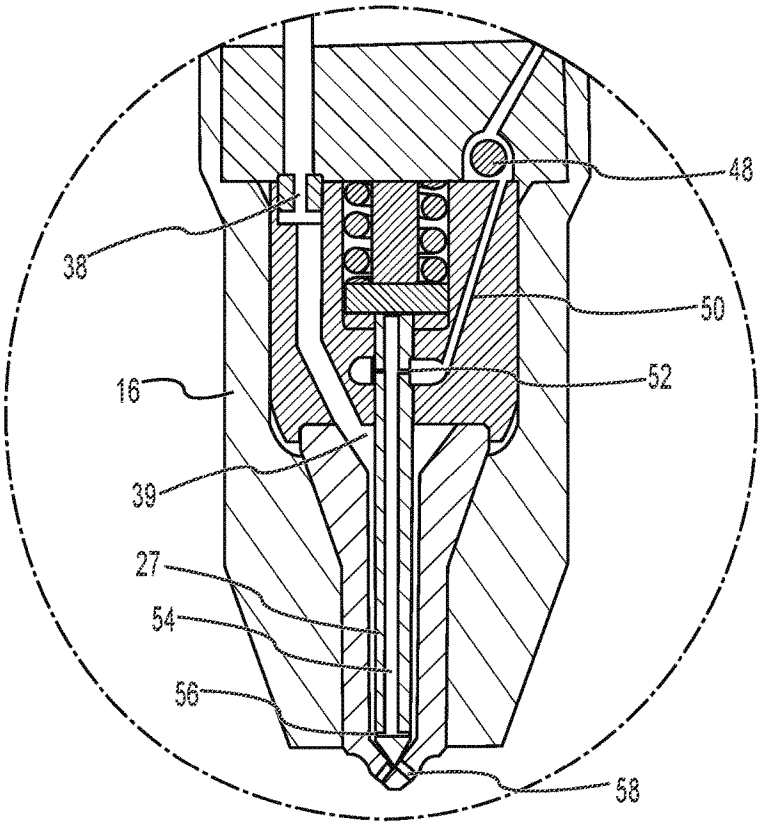
FIG. 1B is an enlarged cross-sectional view of the tip of the fuel injector of FIG. 1A.
Figure 1A:
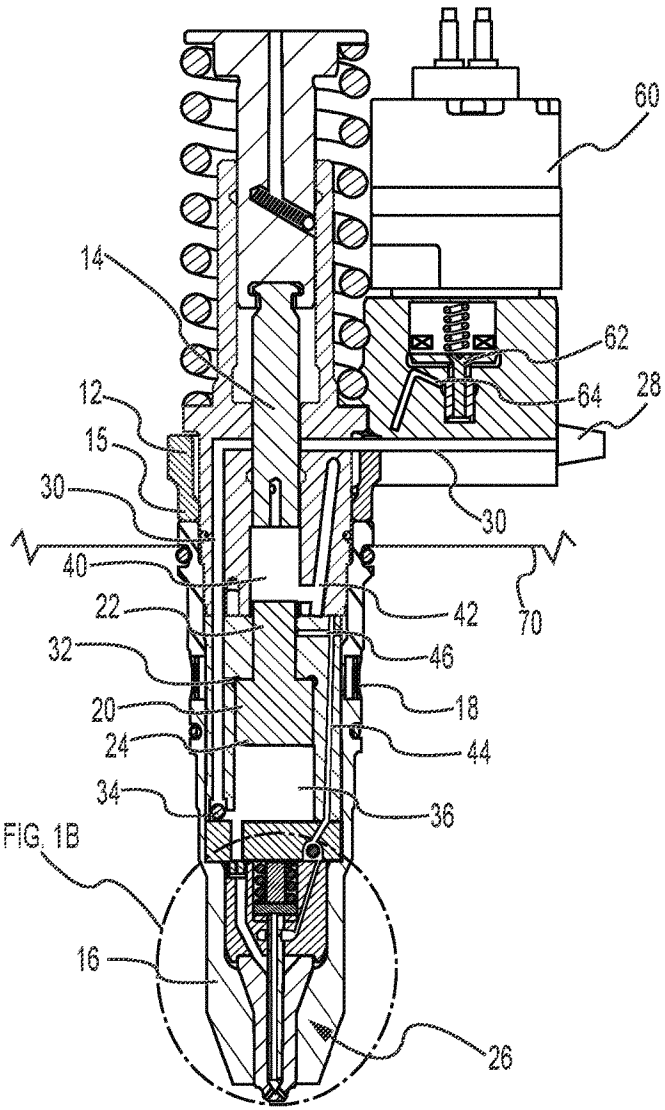
FIG. 1A is a schematic cross-sectional view of a multi-fuel injector, according to aspects of the disclosure.

FIG. 1A illustrates an exemplary fuel injector 12 according to aspects of the present disclosure. Fuel injector 12 may be a multi-fuel injector configured to inject two different types of fuel in a single injection event (e.g., an injection event that includes a pilot injection, a main injection, and/or a post injection) via a single nozzle 16 formed by the distal end portion of fuel injector 12. In some aspects, these two different fuels may both be liquid fuels. As used herein, whether a fuel is "liquid" or "gaseous" is determined based on the state of the fuel as it is delivered to the fuel injector. For example, liquid methanol may be supplied as the primary liquid fuel, while diesel fuel may be supplied as the pilot fuel. In contrast, a fuel delivered to a fuel injector as a gas can be considered as a gaseous fuel, even if the gaseous fuel is stored in a liquid state.

As used herein a "primary" fuel refers to a fuel that, under steady state operating conditions of the internal combustion engine, is injected at a volume that is 50% or more of the total volume of fuel injected into a particular combustion chamber of the engine during an injection event that includes a pilot injection (e.g., of diesel fuel) and a main injection (e.g., of methanol). A "pilot fuel" may refer to a fuel that is mostly or entirely injected before the primary fuel in an injection event. Additionally, while the terms "pilot fuel" and "primary fuel" correlate to the orders in which these different fuels are injected, as understood, the pilot fuel injection and primary fuel injection may occur continuously, and may include the injection of a mixture of the two fuels for a period of time, in contrast to some injection methods in which the pilot and main injections are separated by a period of time during which no fuel is injected.

Multi-fuel injector 12 may have a configuration with multiple plungers. In the example shown in FIG. 1A, injector 12 may include a mechanically-driven (e.g., cam-driven) plunger 14, a hydraulic chamber 40 that forms a control chamber of injector 12, a primary fuel reservoir 36, a primary fuel plunger 20 that causes injection of primary fuel, and an injection valve 26. Fuel injector 12 may include a plurality of fuel connections, including a pilot fuel connection 18 for supplying and draining pilot fuel, and a primary fuel supply connection 28. While only inlet connections 18 and 28 are shown in FIG. 1A, as understood, fuel injector 12 may include an outlet connection 18 in a distal portion of injector 12 an outlet connection 28 connected downstream of a spill valve 62, as described below.

Fuel injector 12 may be part of a fuel injection system installed in an internal combustion engine. This system may include a plurality of fuel injectors 12 secured within a series of bores in one or more cylinder heads 70 of the engine. When installed in the engine, injector 12 may present primary fuel supply connection 28 outside of cylinder head 70 (e.g., between cylinder head 70 and a valve cover) while supply and drain connections 18 are inside of cylinder head 70. This may avoid the need to route an alternative fuel, such as methanol, within cylinder head 70. Cylinder head 70 may be formed with one or more embedded (e.g., cast) fuel paths that are configured to circulate fuel to and from connection 18.

In the exemplary configuration illustrated in FIGS. 1A and 1, the path for guiding primary fuel within fuel injector 12 (also referred to herein as the "primary fuel path") may begin at fuel supply connection 28 and end at nozzle orifices 58 (FIG. 1). This primary fuel path may include primary fuel passage 30 downstream of primary fuel supply connection 28, such that the primary fuel path bypasses plunger 14 to isolate plunger 14 from the primary fuel. The primary fuel path may descend from primary fuel passage 30 towards a distal end of fuel injector 12, to a first primary fuel valve 34 (e.g., a check valve) connecting primary fuel passage 30 to primary fuel reservoir 36. The primary fuel path may extend from primary fuel reservoir 36 downstream to an optional second primary fuel valve 38 (FIG. 1B) that permits a flow of primary fuel to a fuel injection chamber 39 that surrounds at least a portion of an injection valve member 27 of injection valve 26. One or more nozzle orifices 58 may form the downstream end of the primary fuel path that face a combustion chamber when injector 12 is installed within cylinder head 70.

A pilot fuel path, which is isolated from the primary fuel path with the exception of fuel injection chamber 39, may extend through a series of passages within injector 12 downstream of a supply connection 18. The pilot fuel path may be divided into two portions, including a first portion for controlling pressurization of hydraulic chamber 40. A second portion of the pilot fuel path may directly guide a flow of fuel from connection 18 to radial fill passages 52 (FIG. 1B) or 53 (FIG. 2B), described below, for injecting this pilot fuel via nozzle 16. While these portions, for supplying fuel to chamber 40 and for supplying fuel to nozzle 16, respectively, may both be connected to supply and drain connections 18, these two portions may be isolated from each other such that the pressurization of fuel within chamber 40 does not substantially impact the pressure of pilot fuel within nozzle 16. For example, spill valve 62, when closed, may isolate chamber 40 from connection 18 and from pilot fuel supply passage 44.

The first portion of the pilot fuel path within injector 12 may include hydraulic chamber 40, a fill and spill passage 42 connecting hydraulic chamber 40 to a spill valve connection passage 64, spill valve 62, and a supply/drain path (not shown) connected to spill valve 62. Fill and spill passage 42 may be connected to spill valve 62, and to the supply/drain path to fluidly connect passage 42 to connection 18 via spill valve 62. The first portion of the pilot fuel path may allow an electronic control module in communication with interface 60 to control pressurization of fuel within hydraulic chamber 40 with the position of spill valve 62, as described below.

A second portion of the pilot fuel path may enable the supply of pilot fuel to nozzle 16 of injector 12. The second portion may include a pilot fuel supply passage 44 having a pilot fuel lubrication passage 46, a nozzle fill passage 50 (FIG. 1B) connected downstream of pilot fuel supply passage 44, one or more radial fill passages 52, a hollow interior passage 54 formed within injection valve member 27 downstream of radial fill passages 52 extending through a body of injection valve member 27, and one or more radially-extending exit passages 56 at a distal end portion of injection valve member 27. Pilot fuel supply passage 44 may be connected downstream of pilot fuel connection 18 to enable a pressure of fluid introduced at connection 18 to passively control (e.g., without use of solenoid valve within injector 12) a quantity of pilot fuel metered into nozzle 16, as described below.

A check valve, such as pilot fuel check valve 48, may be provided in one or more locations of the second portion. In the configuration illustrated in FIG. 1B, pilot fuel check valve 48 may be provided within nozzle fill passage 50 to prevent pilot fuel within passage 50 from moving upstream with respect to hollow interior passage 54 when spill valve 62 is energized and pressure begins building in chamber 40. A downstream end of the second portion of the pilot fuel path may extend within fuel injection chamber 39 to enable pilot fuel to encounter and displace some primary fuel present within fuel injection chamber 39.

In some aspects, when primary fuel valve 38 is present in the primary fuel path, displaced primary fuel may leak in a controlled manner upstream of primary fuel valve 38, preventing excess pressure within fuel injection chamber 39. While primary fuel valve 38 may include an orifice or other path for controlled leakage of primary fuel in an upstream direction, in at least some configurations, primary fuel valve 38 is a check valve that does not permit a leak, as shown in check valve 38 in FIG. 2B. During an injection event when nozzle orifices 58 are opened, this pilot fuel and the primary fuel are able to exit nozzle 16 via nozzle orifices 58.

In the primary fuel path, primary fuel reservoir 36 may extend below plunger 20 to store primary fuel that is to be injected via nozzle orifices 58. In the pilot fuel path, hydraulic chamber 40 may extend above plunger 20 to control an amount of force acting on the proximal end of plunger 20. In particular, primary fuel plunger 20 may be secured within body 15 of injector 12 such that a proximal narrowed end 22 of plunger 20 defines a bottom end of hydraulic chamber 40, while an enlarged distal end 24 having a diameter that is larger than the diameter of proximal narrowed end 22, and larger than the diameter of plunger 14, defines an upper end of primary fuel reservoir 36.

Primary fuel plunger 20 may be formed of a material that is compatible with an alternative fuel, such as an alcohol-based fuel or alcohol-containing fuel (e.g., a fuel having 25% or more, 50% or more, or 75% or more, by volume, of alcohol such as methanol, ethanol, or combinations of two or more alcohols). Alternatively, plunger 20 may include one or more materials that are generally considered incompatible with an alcohol-based fuel (e.g., a material that may tend to corrode, scuff, and/or experience wear at an increased rate in the presence of methanol fuel), the plunger 20 being coated with a material that is compatible with alcohol-based fuel.

Primary fuel plunger 20 may be biased toward a position that maximizes the size of primary fuel reservoir 36, this position of primary fuel plunger 20 being shown in FIG. 1A. In some aspects, the pressure of fluid supplied to primary fuel reservoir 36 and a reduced pressure within hydraulic chamber 40 due to the return of plunger 14 may result in a net positive pressure in chamber 40 below primary fuel plunger 20, this pressure being sufficient to return of primary fuel plunger 20 to a resting position within an appropriate period of time following the conclusion of an injection event, allowing primary fuel reservoir 36 to fill for a subsequent injection. However, if desired, a biasing element such as a spring may extend from enlarged distal end 24 to a wall at the bottom of primary fuel reservoir 36 to bias primary fuel plunger 20 upward. A biasing element may improve the responsiveness of primary fuel plunger 20, for example.

In some aspects, plunger 20 may be lubricated to reduce wear and prevent sticking. For example, a primary fuel lubrication passage 32 may be configured to supply primary fuel as the lubricant for enlarged distal end 24. Primary fuel lubrication passage 32 may receive fuel when primary fuel plunger 20 moves towards a floor of primary fuel reservoir 36, allowing this fuel to surround a portion of proximal end 22 extending below lubrication passage 32 (e.g., extending into reservoir 36). Lubrication passage 32 may be connected to a drain passage (not shown), allowing for the removal of fuel around this portion of end 22 when primary fuel plunger 20 returns toward a retracted, resting position (upward in FIGS. 1A and 1).

Pilot fuel lubrication passage 46 may be configured to provide pilot fuel to an annular space of narrowed end portion 22 to lubricate this portion of primary fuel plunger 20. While plunger 20 may be lubricated by both primary fuel and pilot fuel, in at least some configurations, primary fuel plunger 20 may be lubricated solely with the pilot fuel.

Body 15 may also include one or more passages for supplying lubrication to plunger 14, if desired. In some configurations, plunger 14 may be isolated from the primary fuel and lubricated solely by the pilot fuel. This may enable the construction of plunger 14 from one or more materials that are compatible with a traditional fuel, such as diesel, but without the need to manufacture plunger 14 with materials compatible with an alternative fuel, such as methanol.

The proximal end of body 15 may be connected to an electrical control interface 60, which includes one or more electrical connections for control of fuel injector 12. For example, an electronic control module may control, via control interface 60, a solenoid of spill valve 62. Spill valve 62 may be biased into an open position in which passage 42 is connected to a drain from which fuel exits fuel injector 12 and is circulated to a low-pressure fuel circulation system. Thus, activating a solenoid for valve 62 may cause valve 62 to close. When spill valve 62 is in the closed position, passage 42 may be blocked from the drain, enabling pressurization of fluid within hydraulic chamber 40.

Figure 2B:
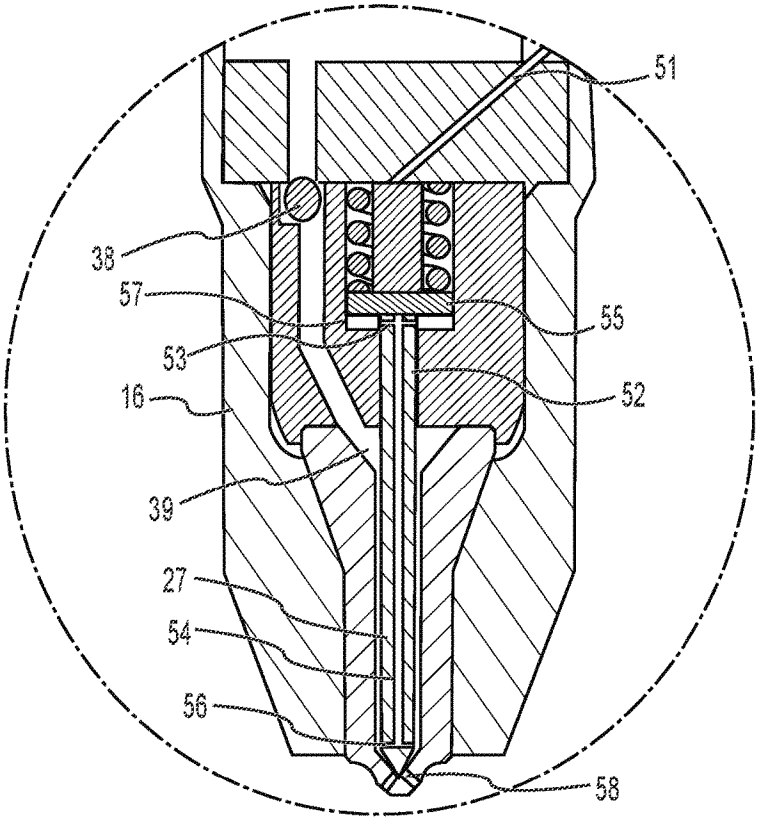
FIG. 2B is an enlarged cross-sectional view of the tip of the fuel injector of FIG. 2A
Figure 2A:
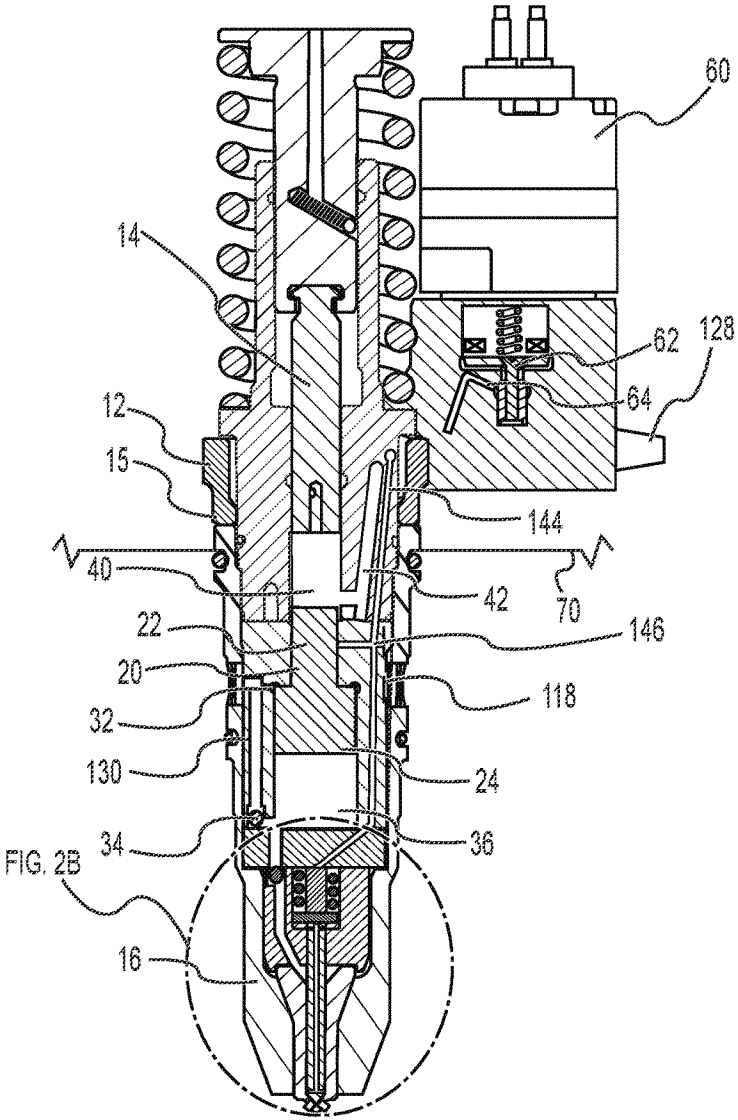
FIG. 2A is a schematic cross-sectional view of an alternate configuration of the multi-fuel injector shown in FIG. 1A, according to aspects of the disclosure.

FIGS. 2A and 2B illustrate a second exemplary embodiment of fuel injector 12. In the configuration illustrated in FIGS. 2A and 2B, elements that have the same structure and/or function as the corresponding features of FIGS. 1A and 1B are identified with the same reference numeral.

As shown in FIG. 2A, a circumferential wall of body 15 secured within cylinder head 70 may include a primary fuel supply and drain connection 118 in place of connection 18 illustrated in FIG. 1A. Primary fuel connection 118 may be configured for connecting the primary fuel path to an alternate fuel source, such as an alcohol-containing fuel, as described above. In particular, connection 118 may be in fluid communication with a primary fuel passage 130 that contains first primary fuel valve 34, primary fuel reservoir 36 and fuel injection chamber 39 in a manner similar to primary fuel passage 30 described above with respect to FIGS. 1A and 1B.

A pilot fuel connection 128 may be connected to injector 12 to supply pilot fuel from a passage outside of cylinder head 70. Pilot fuel connection 128 may be connected to spill valve 62 which is in turn selectively connected to fill and spill passage 42, as well as to a pilot fuel supply passage 144. Fill and spill passage 42 may also be connected to spill valve 62 and spill valve connection passage 64 such that spill valve 62 can control pressurization of fuel within hydraulic chamber 40.

As shown in FIG. 2B, a nozzle fill passage 51 may extend from a lower end of pilot fuel supply passage 144 (FIG. 2A) to provide a supply of fuel to passage 54 of valve member 27. Passage 51 may be connected to passage 54 of valve member 27 via an annular fuel chamber 57 or by one or more additional passages (not shown) extending between passage 51 and passage 54. One or more radial passages 53 may be formed at or near the proximal end of passage 54 enabling communication with annular fuel chamber 57. A spacer member 55 may define a proximal end of chamber 57 and form a seal that prevents flow of fuel in a proximal direction (e.g., towards a spring mechanism for biasing valve member 27).

If desired, materials of cylinder head 70 may be selected to supply an alcohol-containing fuel, such as methanol, via connection 118 in the embodiment shown in FIGS. 2A and 2B. For example, methanol or another primary fuel may be supplied from an interior of cylinder head 70 by one or more interior fuel supply passages of cylinder head 70 that are formed with a methanol-compatible material or coating. Methanol-compatible materials may further be used for connection 118 and each of the primary fuel passages downstream of connection 118. Like the configuration of FIGS. 1A and 1B, injector 12 as shown in FIGS. 2A and 2B may include a primary fuel path that is isolated with respect from the pilot fuel path, except at fuel injection chamber 39 within nozzle 16. Additionally, plunger 14 may be isolated from the primary fuel path, as also described above.

While fuel injector 12 may include a mechanically-driven plunger 14 (e.g., driven via a cam-shaft) as shown in FIGS. 1A and 2A, if desired, plunger 14 may be driven by a different mechanism. For example, plunger 14 may be hydraulically driven, or otherwise driven in a direction that pressurizes fuel within injector 12.

INDUSTRIAL APPLICABILITY

Multi-fuel injector 12 may be installed in any internal combustion engine that is suitable for use with multiple liquid fuels. Examples of suitable internal combustion engines include engines used for generating power in a stationary machine (e.g., a generator or other electricity-generating device), in a mobile machine (e.g., an earthmoving device, a hauling truck, a drilling machine, etc.), or in other applications in which it may be beneficial to operate an engine with a plurality of different fuels. The internal combustion engine may generate electrical power, and/or motive power, such as for providing power for operating one or more associated systems such as hydraulic systems.

During one or more injection events, injector 12 may inject pilot fuel and primary fuel to a combustion chamber of the internal combustion engine. In some aspects, this may involve injection of pilot fuel via nozzle orifices 58, followed immediately by the injection of primary fuel via the same nozzle orifices 58. To inject fuel with injector 12, spill valve 62 may be closed while plunger 14 is mechanically, hydraulically, or otherwise driven downward, pressurizing pilot fuel within hydraulic chamber 40 of injector 12 and preventing pressurized pilot fuel from draining from injector 12.

Figure 3:
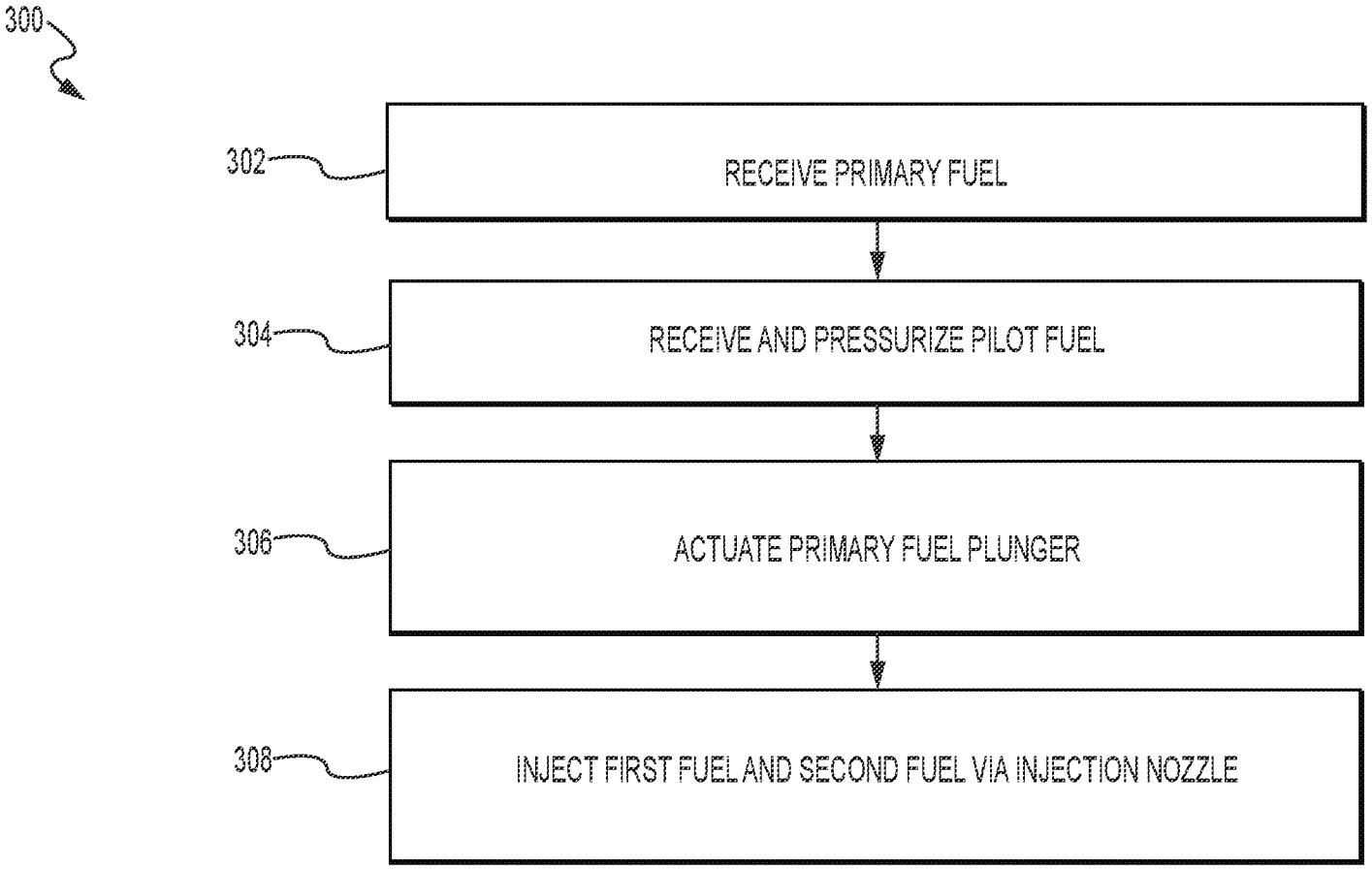
FIG. 3 is a flowchart depicting an exemplary fuel injection method, according to aspects of the disclosure.

FIG. 3 includes a flowchart for an exemplary method 300 that may be performed during the operation of an internal combustion engine that includes multi-fuel injectors 12. During method 300, the injection of fuel may be facilitated with one or more electronically-controlled valves, such as spill valve 62. During method 300, injection may occur due to the motion of two separate plungers within body 15. For example, a driven plunger 14 may be depressed by a cam that physically contacts a proximal end of plunger 14 or a plunger assembly that includes plunger 14. Primary fuel plunger 20 may be indirectly controlled via spill valve 62 and the movement of plunger 14. For example, when spill valve 62 is closed, pressurized incompressible fluid within hydraulic chamber 40 may drive primary fuel plunger 20 downward.

During method 300, the presence of pilot fuel within nozzle fill passage 50 downstream of pilot fuel check valve 48 may be controlled based on the pressure of the pilot fuel. Thus, fuel in fuel injection chamber 39 may be received via one or more radial fill passages 52, hollow interior passage 54, and one or more radially-extending exit passages 56, based on the pressure of pilot fuel upstream of pilot fuel check valve 48. Method 300 may therefore enable use of a plunger 14 that is isolated from the primary fuel, which may be an alternative fuel, and use of a second plunger (primary fuel plunger 20) that is lubricated with the pilot fuel and the primary fuel. In some aspects, some moving parts of injector 12, including plunger 14 and at least a portion of primary fuel plunger 20, may have minimal or no exposure to an alternative fuel used as a primary fuel, the alternative fuel having reduced viscosity, reduced lubrication ability, and/or may be more corrosive as compared to conventional fuels or lubricants used in other injectors.

A first step 302 of method 300 may include receiving primary fuel. The primary fuel may be, for example, an alternative fuel including a fuel that contains 25% or more, 50% or more, or 75% or more, by volume, of alcohol such as methanol, ethanol, or alcohol blends. During step 302, primary fuel may be received with primary fuel supply connection 28 (FIG. 1A) or with fuel supply connection 118 (FIG. 2A). The received fuel may have a first, relatively low, pressure that is established by one or more fuel pumps and/or pressure regulating valves connected upstream of injector 12. The primary fuel may pass through injector 12 in a generally distal direction via primary fuel passage 30 or 130. The fuel may flow through first primary fuel valve 34 into primary fuel reservoir 36.

A step 304 may include receiving and pressurizing pilot fuel with injector 12. For example, diesel pilot fuel may be received with connection 18 (FIG. 1A) or with supply connection 128 (FIG. 2A). Accordingly, based on the particular configuration of injector 12, pilot fuel may be received from inside of cylinder head 70 (e.g., with connection 18 as shown in FIG. 1A) or from outside of cylinder head 70 (e.g., with connection 128 shown in FIG. 2A). The pilot fuel may be guided by a pilot fuel path defined within injector 12. With reference to FIG. 1A, the pilot fuel path, supplied with pilot fuel from drain connection 18, may guide this fuel to locations within fuel injector 12 that include passage 42, passage 44, nozzle fill passage 50, hollow interior passage 54, and to a bottom end of fuel injection chamber 39 adjacent the distal end of injection valve member 27 where the pilot fuel mixes with and displaces primary fuel. Referring to FIG. 2A, primary fuel may be received with primary fuel connection 118. This fuel may be provided to primary fuel passage 130 where the fuel may be guided to primary fuel reservoir 36 in the manner described above for primary fuel passage 30.

During step 304, the pressure of the pilot fuel within hydraulic chamber 40 may be modified to allow the pilot fuel to act as a control fluid for injector 12. In particular, the pressure of pilot fuel may be increased by holding spill valve 62 in the closed position while plunger 14 is depressed mechanically. This may block pilot fuel from returning from fill and spill passage 42 to connection 18 (FIG. 1A) or 118 (FIG. 2A). As plunger 14 proceeds in a downward direction, the pressure of fuel within hydraulic chamber 40 may increase until the pressure reaches a level that actuates primary fuel plunger 20 and that actuates injection valve member 27, as described below.

Additionally, the quantity of pilot fuel that enters nozzle 16 via hollow interior passage 54 may be controlled based on the pressure of the pilot fuel. In particular, the quantity of fuel within passage 54, or otherwise located within nozzle 16 may be controlled by adjusting a pressure difference between the pilot fuel and the primary fuel supplied to injector 12 (the pilot fuel having a greater pressure), and/or by adjusting a fill time corresponding to the amount of time between injection events. The quantity of pilot fuel within nozzle 16 may also be impacted by the volume (i.e., capacity) of fuel injection chamber 39 and the difference between the compressibilities of the primary and pilot fuel. The quantity of pilot fuel in nozzle 16 may be impacted by the compressibility of fuel within reservoir 36 when an orifice is present in valve 38.

For example, fluid may be supplied at a pressure that is sufficient to open pilot fuel check valve 48 and provide fuel to an interior of injection valve member 27. The amount of pilot fuel that exits injection valve member 27 via one or more radially-extending exit passages 56 and enters fuel injection chamber 39 may further depend on the pressure at which the pilot fuel is supplied to injector 12, as well as the time between injections. Thus, the pressure of pilot fuel in the second portion of the pilot fuel path, described above, may be set based on the desired quantity of pilot fuel for injection.

A step 306 may include actuating a primary fuel plunger, such as primary fuel plunger 20. Plunger 20 may be actuated with fluid that was pressurized in step 304. While spill valve 62 is held in a closed position (e.g., by generating a command for energizing a solenoid of valve 62 with an electronic control module) plunger 14 may cause pressure to act on an upper surface of proximal narrowed end 22 and drive primary fuel plunger 20 downward, as the pressure of pilot fuel within hydraulic chamber 40 may be significantly larger than the pressure of primary fuel within primary fuel reservoir 36. If desired, the sizes of proximal narrowed end 22 and enlarged distal end 24 may be set in a manner that is based on the expected pressures, maximum expected fuel deliveries, and corresponding forces, generated in hydraulic chamber 40 and primary fuel reservoir 36.

A step 308 may include injecting both the primary fuel and the pilot fuel via nozzle 16. In particular, step 308 may include injecting two different types of fuel from a single set of nozzle orifices 58 in a single tip of nozzle 16. For example, pilot fuel may enter injection valve member 27 from pilot fuel supply passage 44, nozzle fill passage 50, and one or more radial fill passages 52. This fuel may travel downward within hollow interior passage 54 and enter fuel injection chamber 39 via one or more radially-extending exit passages 56, displacing some primary fuel at the end of fuel injection chamber 39 in an upstream direction. Use of a pilot fuel with a density that is higher than the density of the primary fuel may also act to restrict flow of pilot fuel upwards in chamber 39.

Also during step 308, primary fuel within nozzle 16 downstream of valve 38 may have a pressure that was increased in step 306. This pressurized fuel within fuel injection chamber 39 may raise a hydraulic surface (not shown) on injection valve member 27 so as to cause member 27 to lift from nozzle orifices 58, opening nozzle orifices 58 to initiate an injection event. Additionally, pressurization of primary fuel may move check valve 48 (FIG. 1B) to a proximal blocking position that prevents reverse flow of pilot fuel. During the injection event, pilot fuel may be injected mostly or entirely before the primary fuel. This injection may be a substantially continuous event supplying a stratified charge of the two fuels within nozzle 16. In at least some aspects, there may be a transition period during which mixed pilot and primary fuel is injected before a transition to solely primary fuel. Following the injection of the pilot fuel, this fuel may combust (e.g., via autoignition), generating a pilot flame that facilitates complete combustion of the primary fuel.

The disclosed system and method may enable utilization of a single fuel injector to inject two different types of liquid fuels. A primary fuel and a pilot fuel may be received at different locations, one type of fuel being supplied from one or more passages within a cylinder head, while the other type of fuel is supplied from a location outside of the cylinder head. The two fuels may be isolated from each other, except within the nozzle of the injector where a controlled amount of pilot fuel displaces primary fuel prior to injection. This may allow the pilot fuel to be injected first into a combustion chamber, providing more complete combustion of the primary fuel, which may be a fuel associated with environmental or other benefits. In some configurations, the isolation of at least some moving parts of the injector from the primary fuel may avoid cavitation or other damage, may reduce seat wear, and may avoid scuffing. Injector components that include a portion that is exposed to the pilot fuel rather than the alternative primary fuel may also realize some or all of these benefits.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A fuel injector capable of injecting a plurality of different fuels in a single fuel injection event, the fuel injector comprising:

a body including a primary fuel path and a pilot fuel path;

a first plunger in fluid communication with the pilot fuel path;

a second plunger in fluid communication with the primary fuel path and with the pilot fuel path;

a pilot fuel connection configured to be positioned within a cylinder head of an internal combustion engine when the fuel injector is installed in the internal combustion engine;

a hydraulic control chamber within the pilot fuel path; and an injection valve at which the primary fuel path and the pilot fuel path connect to each other.

2. The fuel injector of claim 1, wherein the first plunger is isolated from the primary fuel path.

3. The fuel injector of claim 1, further including a spill valve included in the pilot fuel path, the spill valve having a first position in which fluid is configured to drain from the hydraulic control chamber and a second position in which fluid is prevented from draining from the hydraulic control chamber.

4. The fuel injector of claim 1, wherein the second plunger includes a stepped shape including a narrowed end extending toward the hydraulic control chamber and an enlarged portion extending away from the narrowed end.

5. The fuel injector of claim 4, wherein the enlarged portion includes a distal face configured to pressurize fuel within a primary fuel chamber.

6. The fuel injector of claim 5, further including a valve positioned downstream of the primary fuel chamber and upstream of a fuel injection chamber at which the primary fuel path and the pilot fuel path connect to each other.

7. The fuel injector of claim 1, wherein the injection valve includes an injection valve member with a hollow interior, the hollow interior forming a portion of the pilot fuel path.

8. The fuel injector of claim 1, wherein at least a portion of the first plunger and at least a portion of the second plunger are in fluid communication with respective lubrication passages, the lubrication passages being part of the pilot fuel path.

9. A fuel injection method, comprising:

receiving a primary fuel with a primary fuel path within a body of a fuel injector;

receiving a pilot fuel with a pilot fuel path within the body of the fuel injector, the pilot fuel having a higher cetane number as compared to a cetane number of the primary fuel;

pressurizing pilot fuel within a hydraulic control chamber in the pilot fuel path;

supplying primary fuel to a nozzle of the fuel injector with a primary fuel plunger connected to the hydraulic control chamber;

supplying pilot fuel to the nozzle of the fuel injector; and injecting the pilot fuel and the primary fuel from the nozzle of the fuel injector.

10. The method of claim 9, wherein pressurizing the pilot fuel is performed with an electronically-controlled valve and hydraulically-driven or mechanically-driven movement of a plunger.

11. The method of claim 9, wherein the pilot fuel is received with a connection positioned within a cylinder head of an internal combustion engine.

12. The method of claim 9, wherein the pilot fuel is injected after passing from a hollow interior of an injection valve to an interior of the nozzle.

13. The method of claim 9, wherein the primary fuel plunger includes a proximal end that faces the hydraulic control chamber and a distal end that faces a primary fuel chamber.

14. The method of claim 13, wherein the proximal end of the primary fuel plunger has a smaller diameter as compared to a diameter of the distal end of the primary fuel plunger.

15. The method of claim 9, wherein the primary fuel is a liquid fuel and the pilot fuel is a liquid fuel.

16. A fuel injector, comprising:

a body;

a primary fuel connection configured to receive primary fuel;

a pilot fuel connection configured to receive pilot fuel, the pilot fuel connection being positioned within a cylinder head of an internal combustion engine when the fuel injector is installed in the internal combustion engine;

a plunger that is isolated from the primary fuel;

a hydraulic chamber defined in part with the plunger, the hydraulic chamber being in fluid communication with the pilot fuel connection; and a second plunger that, when actuated, is configured to deliver the primary fuel to a nozzle of the fuel injector.

17. The fuel injector of claim 16, wherein the pilot fuel connection is fluidly connected to an electronically-controlled valve of the fuel injector.

18. The fuel injector of claim 17, wherein the electronically-controlled valve is configured to permit a flow of pilot fuel from the hydraulic chamber.

19. The fuel injector of claim 16, further including a check valve in fluid communication with the pilot fuel connection, the check valve being secured within a body of the injector to block a flow of fluid from the nozzle towards a primary fuel reservoir.

20. The fuel injector of claim 19, further including an additional check valve in fluid communication with the primary fuel connection, the additional check valve being secured with the body of the fuel injector to block a flow of fluid from the nozzle towards the pilot fuel connection.

* * * * *